US005110423A

United States Patent [19]

Little et al.

[11] Patent Number: 5,110,423

[45] Date of Patent: May 5, 1992

[54] BATH FOR ELECTROPLATING BRIGHT TIN OR TIN-LEAD ALLOYS AND METHOD THEREOF

[75] Inventors: John L. Little, Cranston, R.I.; Philip W. Schultz, East Lansing, Mich.; Harry Kroll, East Greenwich, R.I.

[73] Assignee: Technic Inc., Cranston, R.I.

[21] Appl. No.: 529,351

[22] Filed: May 25, 1990

[51] Int. Cl.[5] ..... C25D 3/56; C25D 3/60; C25D 3/30

[52] U.S. Cl. ..... 205/254; 106/1.05; 205/304

[58] Field of Search ..... 204/44.4, 54.1; 106/1.05

[56] References Cited

U.S. PATENT DOCUMENTS 3,616,306 10/1971 Conoby et al. ..... 204/DIG. 2
4,582,576 4/1986 Opaskar et al. ..... 204/44.4
4,844,780 7/1989 Lee ..... 204/44.4

*Primary Examiner*—John Niebling
*Assistant Examiner*—Steven P. Marquis
*Attorney, Agent, or Firm*—Ernest V. Linek

[57] ABSTRACT

This invention relates to alkyl and alkanol sulfonic acid plating baths and to methods for plating tin and tin-lead alloys. It also relates to low foaming wetting systems based on low to moderate foaming surfactants and soluble, non-silicon containing defoamers, and to low volatility brightener systems.

48 Claims, No Drawings

BATH FOR ELECTROPLATING BRIGHT TIN OR TIN-LEAD ALLOYS AND METHOD THEREOF

FIELD OF THE INVENTION

This invention relates to alkyl and alkanol sulfonic acid plating baths and to methods for plating tin and tin-lead alloys. It also relates to low foaming wetting systems based on low to moderate foaming surfactants and soluble, non-silicon containing defoamers, and to low volatility brightener systems.

BACKGROUND OF THE INVENTION

Tin and tin-lead plating baths using alkane or alkanol sulfonic acids and their salts in the place of fluoroboric acid and its salts are well known and have been widely put into production in recent years. Corrosiveness of the fluoroboric acid systems and related high maintenance costs have thus been avoided.

Recently, several low to moderate foaming alkane and alkanol sulfonate baths have been patented (see, e.g., U.S. Pat. Nos. 4,871,429; 4,880,507; and 4,923,576). Low foaming characteristics are important for plating baths utilized in modern high speed plating equipment. High current density operation causes evolution of large volumes of gas at the electrodes, causing gross foam buildup. Additionally, pumping and higher operating temperatures associated with high operating speeds can contribute to the foaming problem. Baths can foam over the tank walls, resulting in operational shutdown and exposure to toxic chemicals.

In high speed plating systems, parts are usually carried through the plating tanks on a continuous belt. In many cases, it is desirable for economic or end-use reasons to plate the parts to only a certain height. A head of foam in the plating tank can interfere detrimentally with such a process because the portion of the parts within the foam head are partially plated. It is thus impossible, in a high foaming system, to sharply define plated and unplated regions of the parts.

High current densities and higher operating temperatures associated with continuous plating operations contribute to the loss by evaporation of commonly used brightening agents, typically lower molecular weight aldehydes. Most brightening systems are made up of a low molecular weight aldehyde, such as acetaldehyde (bp. 21° C.), plus in many cases a substituted aromatic aldehyde and/or ketone (see for instance, U.S. Pat. Nos. 4,132,610; 4,139,425; 4,384,930; 4,629,999 and 4,844,780). Even at low to moderate plating speeds, acetaldehyde must be replenished frequently due to its high volatility. At high plating speeds, volatilization of acetaldehyde and other low molecular weight aldehydes is rapid. The resulting high concentration of atmospheric acetaldehyde in the vicinity of the plating equipment presents a serious pollution problem.

SUMMARY OF THE INVENTION

The present invention is directed to a non-foaming plating bath. This invention is particularly directed to plating baths containing dialdehydes and their precursors having low vapor pressures, which are capable of producing mirror-bright electrodeposits of tin and tin-lead alloys. The low volatility of these additives eliminates the health hazards of the more volatile aldehydes disclosed in the prior art.

This invention also provides plating baths and a plating process which will yield bright tin or tin-lead plates of high luster over a wide range of current densities.

In sum, the present invention is directed to a tin or tin-lead alloy plating bath for the electrodeposition of bright plates which comprises:

A. A plating bath containing a bath soluble alkane or alkanol sulfonic acid;

B. Tin alkane or alkanol sulfonate or both tin and lead alkane or alkanol sulfonate;

C. A first low volatility brightening agent selected from the group consisting of (a) a dialdehyde represented by the formula

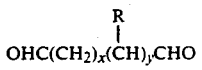

wherein R is —OH or alkyl; x is an integer 0 to 5; y is an integer 0 to 1; and/or (b) a dialdehyde precursor capable of undergoing acid hydrolysis selected from the group consisting of i. a substituted dihydropyran represented by the following two formulas:

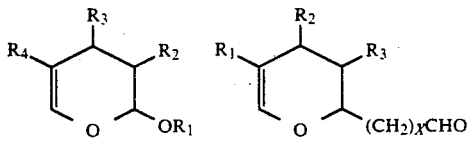

wherein $R_1$, $R_2$, $R_3$, and $R_4$ represent hydrogen or a $C_{1-5}$ alkyl group; x is an integer from 0 to 5; and/or ii. a substituted dihydrofuran represented by the formulas

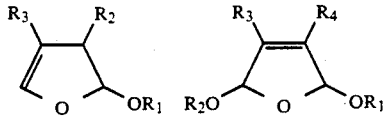

wherein $R_1$, $R_2$, $R_3$ and $R_4$ represent hydrogen or a $C_{1-5}$ alkyl group; and/or iii. a substituted tetrahydrofuran represented by the formula

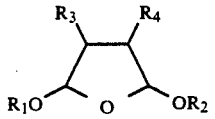

wherein $R_1$, $R_2$, $R_3$ and $R_4$ represent hydrogen or a $C_{1-5}$ alkyl group; and/or iv. an acetal of dialdehyde represented by the formula

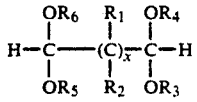

wherein $R_1$, $R_2$, $R_3$, $R_4$, $R_5$ and $R_6$ represent hydrogen or a $C_{1-5}$ alkyl group; n is an integer form 1 to 10; and/or v. a hydroxysulfonate represented by the formula

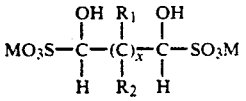

wherein $R_1$ and $R_2$ represent hydrogen, hydroxy-, or a $C_{1-5}$ alkyl group; M is an alkali metal, x is an integer from 0 to 10;

D. A second low volatility brightening agent selected from the group consisting of (a) aromatic aldehydes and substituted aromatic aldehydes, excluding benzaldehyde; and/or (b) aromatic ketones or substituted aromatic ketones; and/or (c) carboxaldehydes of heterocyclic rings or substituted heterocyclic rings; and E. A surfactant selected from the group consisting of:

(a) a nonionic surfactant selected from the group represented by the formula

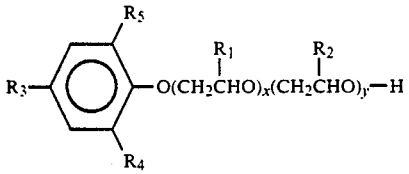

wherein $R_1$ and $R_2$ represent hydrogen or $—CH_3$; $R_3$, $R_4$ and $R_5$ represent H, a $C_{1-20}$ alkyl, benzyl, and/or a styryl group; x and y are integers from 1-30; and/or (b) a nonionic surfactant that is a block copolymer of ethylene and propylene oxide selected from the group represented by the formula

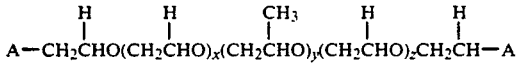

wherein A represents a halogen, —OH, or —OR, where R is a $C_{1-15}$ group; x, y, and z are integers from 1 to 100; and/or (c) a nonionic surfactant that is a block copolymer of ethylene and propylene oxide selected from the group represented by the formula

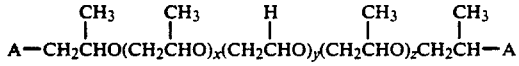

wherein A represents a halogen, —OH, or —OR, where R is a $C_{1-15}$ group; x, y, and z are integers from 1 to 100;

F. A non-silicon defoaming agent selected from the group consisting of:

(a) a polypropylene oxide or nonionic surfactant from the group represented by the formula

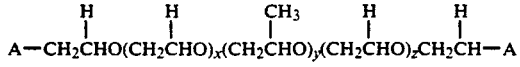

wherein A represents a halogen, —OH, or —OR, where R is a $C_{1-15}$ alkyl group; x, y, z are integers from 1 to 100; with the condition that no more than 10% of the compound is polyethylene oxide; and/or (b) a polyproplyene oxide or nonionic surfactant from the group represented by the formula

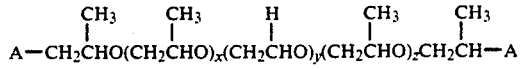

wherein A represents a halogen, —OH, or —OR, where R is a $C_{1-15}$ alkyl group; x, y, z are integers from 1 to 100 with the condition that no more than 10% of the compound is polyethylene oxide; and/or (c) an aliphatic alcohol, represented by the formula

R—OH wherein R is a $C_{5-30}$ alkyl group; and/or (d) an ethoxylated alkyl phenol from the group represented by the formula

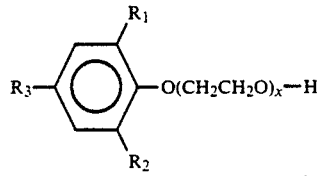

wherein $R_1$, $R_2$ and $R_3$ represent hydrogen or $C_{1-16}$ alkyl groups with the condition that there is at least one alkyl group; x is an integer from 1-5; and G. Antioxidants selected from the group consisting of 1-phenyl-3-pyrazolidinone, resorcinol, catechol, and hydroquinone sulfonate.

DETAILED DESCRIPTION OF THE PREFERRED EMBODIMENTS

The present invention is particularly concerned with providing electroplating baths containing one or more of the additives herein disclosed. The additives include low to moderate foaming surfactants, non-silicon containing soluble defoamers, and low volatility brighteners.

The preferred electrolytes are water soluble alkane or alkanol sulfonic acids, the most preferred being methane sulfonic acid. The preferred concentration of the electrolyte is between from about 2-25 percent, the most preferred range being from about 5-20 percent.

Tin and lead salts of methane sulfonic acid are the preferred sources of metals. The water-soluble tin in the baths, as tin methane sulfonate, is from about 10-100 grams per liter, with the most preferred concentration range being from about 20-60 grams per liter. The concentration of lead in the baths, as lead methane sulfonate, is from about 0.25-50 grams per liter, with the preferred range being from about 1-25 grams per liter. It is recognized by those versed in the art that the tin-lead concentration ratio in the bath must be adjusted, depending on other bath conditions, to obtain a given desired tin-lead ratio in the electroplates. The most commercial useful alloys contain from about 60 to 95 percent tin.

The purpose of surfactants in tin and/or lead plating baths is to work as grain refiners, producing smooth deposits. The surfactants of this invention work synergistically with the brightening agents to produce a smooth, mirror-bright deposit of tin or tin-lead alloy.

In accordance with the present invention, surfactants that have been found to be effective, either singly or in combination include:

(a) nonionic surfactants represented by the general Formula I:

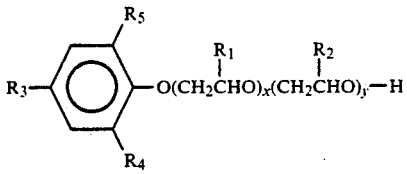

(I)

wherein $R_1$ and $R_2$ represent hydrogen or $—CH_3$; $R_3$, $R_4$, *and* $R_5$ represent H, a $C_{1-20}$ alkyl, benzyl, and/or styryl group; x and y integers from 1 to 30.

(b) nonionic surfactants that are block co-polymers of ethylene and propylene oxide represented by the general Formula IIa:

$$A—CH_2\overset{H}{\overset{|}{C}}HO(CH_2\overset{H}{\overset{|}{C}}HO)_x(CH_2\overset{CH_3}{\overset{|}{C}}HO)_y(CH_2\overset{H}{\overset{|}{C}}HO)_zCH_2\overset{H}{\overset{|}{C}}H—A \quad \text{(IIa)}$$

wherein x, y, and z are integers from 1 to 100; A represents a halogen, a hydroxyl group, or —OR, where R is a $C_{1-15}$ alkyl group.

(c) nonionic surfactants that are block co-polymers of ethylene and propylene oxide represented by the general Formula IIb:

$$A—CH_2\overset{CH_3}{\overset{|}{C}}HO(CH_2\overset{CH_3}{\overset{|}{C}}HO)_x(CH_2\overset{H}{\overset{|}{C}}HO)_y(CH_2\overset{CH_3}{\overset{|}{C}}HO)_zCH_2\overset{CH_3}{\overset{|}{C}}H—A \quad \text{(IIb)}$$

wherein x, y, and z are integers from I to 100; A represents a halogen, a hydroxyl group, or —OR, where R is a $C_{1-15}$ alkyl group.

In the case of some combinations of ingredients, inclusion of an imidazoline, represented by the following general Formula III, is advantageous:

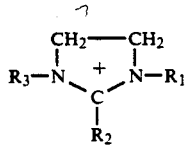

(III)

wherein $R_1$ represents a hydroxy alkyl group containing 2–4 carbon atoms; $R_3$ represents a carboxy alkane group containing 1–4 carbon atoms $R_2$ represents an alkyl group of 1–18 carbon atoms.

Alkoxylated amines are nonionic surfactants that may be advantageously added to some combinations of the ingredients of the invention and are represented by Formula IV:

$$R_{3-n}N((CH_2\overset{R_1}{\overset{|}{C}}HO)_x(CH_2\overset{R_2}{\overset{|}{C}}HO)_y)_n \quad \text{(IV)}$$

wherein $R_1$ and $R_2$ represent hydrogen and $—CH_3$; $R_{3-n}$ represents an alkyl group $C_{1-15}$; x and y are integers from 1 to 70; n is an integer from 1 to 2.

These grain refiners are preferably added to an electroplating bath in concentrations between about 1.0 and 15.0 grams per liter, most preferably between about 2.0 and 8.0 grams per liter. In preferred embodiments of the invention, the grain refiner is represented by Formula I, where $R_1$ and $R_2$ are hydrogen, $R_3$ and $R_4$ are benzyl or styryl groups, and $R_5$ is H.

Even low to moderately foaming surfactants in baths operated at high speed may foam excessively due to high volumes of gas formed at the electrodes, high operating temperatures, and the rapid movement of the solution through the pumping system. The purpose of the defoamer is to minimize or eliminate solution foaming. In accordance with the invention, the following soluble defoamers have been found to be effective:

(a) polypropylene oxides, represented by the general Formulas II*a* and II*b*, wherein $R_1$ and $R_2$ represent hydrogen or $—CH_3$ with the condition that at least one is $—CH_3$; A represents —OH, $—CH_3$ or —OR, where R is a $C_{1-15}$ alkyl group; x, y, and z are integers from 0 to 100 with the condition that no more than 10 percent of the compound is polyethylene oxide.

(b) aliphatic alcohols, represented by the general Formula V:

$$R—OH \quad \text{(V)}$$

wherein R is an aliphatic $C_{5-30}$ group.

(c) ethoxylated alkyl phenols, represented by the general Formula VI:

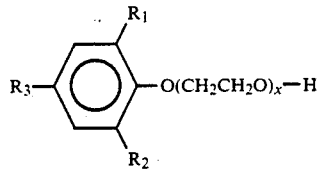

(VI)

wherein $R_1$, $R_2$, and $R_3$ represent hydrogen or a $C_{1-16}$ alkyl group; x is an integer from 1–5.

The preferred defoamer is represented by Formula II, as represented by the Pluronics marketed by the BASF Corp. The useful concentrations range between about 0.1 to 8.0 grams/liter.

The purpose of the brightener system is to provide a sufficiently bright plate over a wide current density range, so that no reflow of the parts is required. Commonly employed brightening systems use a low molecular weight aliphatic aldehyde along with an aromatic aldehyde or ketone. The low molecular weight aliphatic aldehydes are highly volatile, resulting in their rapid loss from solution.

The brightener system of the invention is made up entirely of low volatility compounds and consists of a dialdehyde or a precursor hydrolyzable in acid conditions to a dialdehyde plus an aromatic aldehyde and/or ketone or plus a carboxaldehyde substituted heterocyclic ring.

One aliphatic dialdehyde, glutaric dialdehyde ($OHC(CH_2)_3CHO$), was used in the prior art (U.S. Pat. No. 4,844,780) as part of a ternary or quaternary brightening system for tin or tin-lead. As disclosed in U.S. Pat. No. 4,844,780, highly volatile acetaldehyde is used as part of a two-part secondary brightening agent, with glutaric dialdehyde being part of the primary brightening agent. By contrast, the plating baths of the present invention contain only low volatility brightening agents.

Another patent citing glutaric dialdehyde (as "glutaraldehyde") is U.S. Pat. No. 3,616,306. This patent discloses an aqueous bath for electroplating tin upon various conjuctive substrates contains stannous sulfate, sulfuric acid, an imidazoline derivative, a carbinamine compound, and a cyclic aldehyde or ketone brightener. The bath is highly acidic (sulfuric acid is the electrolyte) and is operable to produce dense, smooth, bright deposits, particularly at relatively high current densities.

We have found that the aliphatic dialdehydes or substituted dialdehydes, or their even less volatile precursors, are generally excellent brighteners for tin or tin-lead when combined with the surfactant-defoamer systems of the present invention and with an aromatic aldehyde and/or ketone or a carboxaldehyde substituted heterocyclic ring compound.

The brightener system of the present invention consists of two parts, neither of which alone provides sufficient brightness over a wide enough current consists of two parts, neither of which alone provides sufficient brightness over a wide enough current density range, but when used in combination produces the desired deposit. The first part of the brightener system consists of an aliphatic dialdehyde, or a substituted aliphatic dialdehyde, or a precursor to one of these compounds which hydrolyzes to it under acid conditions.

The aliphatic dialdehydes may be represented by Formula VI:

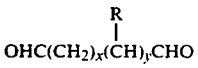

(VII)

wherein R may be —OH or an alkyl group, x is an integer from 0 to 5, and y is an integer from 0 to 1.

Precursors that hydrolyze to any one of the dialdehydes represented by the above formula under the highly acidic conditions of the plating baths of the invention are also effective additives. They are, in many cases, much more stable to oxidation in storage than the dialdehydes themselves. An example is malonaldehyde bis(dimethylacetal), which hydrolyzes under bath conditions to malonic dialdehyde ($OHC(CH_2)CHO$):

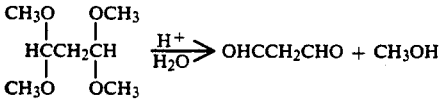

Another example is the acid hydrolysis of 2,5-dimethoxytetrahydrofuran:

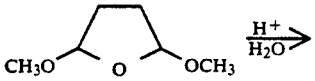

$OHCCH_2CH_2CHO + CH_3OH$

Among other precursors successfully employed to generate an aliphatic dialdehyde or substituted aliphatic dialdehyde in the plating baths of the invention are: 2-methoxy- or 2-ethoxy-3,4-dihydropyran, and 1,4-dihydroxybutane-1,4-disulfonate, disodium salt. It should be recognized that a practitioner skilled in the art could design an appropriate precursor which would generate the appropriate dialdehyde or substituted dialdehyde in an acidic plating bath. The preferred concentration range of the dialdehyde brighteners or their precursors is from about 0.10 to about 20 grams per liter, most preferably from about 0.5 to about 10 grams per liter.

The useful types of dialdehyde precursors are substituted di- or tetrahydrofurans, substituted dihydropyrans, acetals of dialdehydes, or hydroxysulfonates of dialdehydes. The substituted dihydropyrans may be represented by Formula VIII and IX:

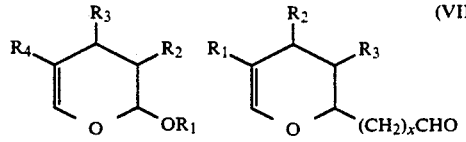

(VIII, IX)

wherein $R_1$, $R_2$, $R_3$, and $R_4$ represent hydrogen or a $C_{1-5}$ alkyl group; x is an integer from 0 to 5.

The substituted dihydrofurans may be represented by Formulas X and XI:

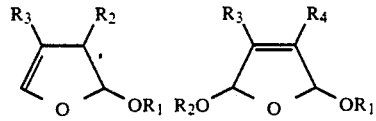

(X, XI)

wherein $R_1$, $R_2$, $R_3$ and $R_4$ represent hydrogen or a $C_{1-5}$ alkyl group.

The substituted tetrahydrofurans may be represented by Formula XII:

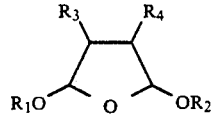

(XII)

wherein $R_1$, $R_2$, $R_3$ and $R_4$ represent hydrogen or a $C_{1-5}$ alkyl group.

The acetals of dialdehydes may be represented by Formula XIII:

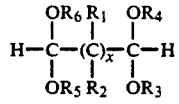

(XIII)

wherein $R_1$, $R_2$, $R_3$, $R_4$, $R_5$ and $R_6$ represent hydrogen or a $C_{1-5}$ alkyl group; x is an integer from 0 to 10.

The hydroxysulfonates may be represented by Formula XIV:

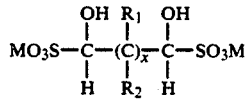

(XIV)

wherein $R_1$ and $R_2$ represent hydrogen, hydroxy-, or a $C_{1-5}$ alkyl group; M is an alkali metal; x is an integer from 0 to 10.

The dialdehyde precursors, besides being of very low volatility, hydrolyze over time in the plating baths of the invention, further minimizing brightener loss. Thus the economic loss of brighteners by evaporation and their resulting presence in ambient air are avoided, saving cost and avoiding possible toxic hazards (for instance, formaldehyde and acetaldehyde, commonly utilized low molecular weight, highly volatile brighteners are classified as cancer suspect agents).

Among compounds successfully employed as the first part of the present brightener system are malonic dialdehyde, glutaric dialdehyde, 2-hydroxyhexanedial, succinic dialdehyde, 2,5-dimethoxytetrahydrofuran, 2,5-dimethoxy-2,5-dihydrofuran, 2-methoxy- or 2-ethoxy-3,4-dihydropyran, 1,4-dihydroxybutane-1,4-disulfonate (disodium salt), and malonaldehyde bis(dimethylacetal). The preferred concentration range of the above brighteners is from about 0.10 to about 20 grams per liter, most preferably from about 0.5 to about 10 grams per liter.

The second part of the brightener system consists of an aromatic aldehyde and/or ketone, or a heterocyclic ring with a carboxaldehyde substituent. Examples of aromatic aldehydes with co-brightening properties in the baths of the invention are pyridine-2-carboxaldehyde, 2-methoxybenzaldehyde, vanillin, 2,4-, 3,4-, or 3,5-dichlorobenzaldehyde, monochlorobenzaldehydes, terephthaldicarboxaldehyde, cinnamaldehyde, and p-tolualdehyde. For the purposes of this invention, cinnamaldehyde is considered an aromatic aldehyde. The preferred concentration range for the aromatic aldehyde brighteners is from about 0.0005-0.50 grams per liter, most preferably from about 0.01 to 0.10 grams per liter.

Among aldehydes containing heterocyclic rings employable as co-brighteners are thiophene carboxaldehyde, pyrrole-2-carboxaldehyde and pyrrolidine carboxaldehyde, to mention but a few.

Among aromatic ketones found to work as co-brighteners with either brighteners of the first type or with combination of these brighteners and an aromatic aldehyde are acetophenone, 2-hydroxyacetophenone, 2',4'-dichloroacetophenone, monochloroacetophenones, and benzylidine acetone. For the purposes of this invention, benzylidine acetone is considered an aromatic ketone. Preferred and most preferred concentrations ranges for the heterocyclic ring carboxaldehydes and aromatic ketones are the same as those cited above for the aromatic aldehydes.

Usually the brightener system employed in plating baths of the present invention consists of a brightener of the first type plus an aromatic aldehyde, a carboxaldehyde substituted heterocyclic ring, or an aromatic ketone. In some cases, however, addition of a third brightener to the system enhances the brightness and/or expands the current density range of the bright area in Hull cell tests.

In preferred embodiments of the invention, the brightening system consists of mixtures of malonic dialdehyde or one of its acid hydrolyzable precursors or glutaric dialdehyde or one of its acid hydrolyzable precursors plus 1-napthaldehyde, a chlorobenzaldehyde, or cinnamaldehyde.

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

EXAMPLES

Example 1 illustrates the effects of various bath soluble defoamers on the foaming characteristics of a 90/10 tin-lead methane sulfonate plating bath of the invention. Examples 2, 3, 10 and 11 show the effect on brightness brought about by the addition of a brightener of the second type to a tin electroplating bath. Examples 4 and 5 similarly show the effect on brightness when a brightener of the first type is added to a tin-lead plating bath of the invention. Examples 6, 7, 8, and 9 illustrate the use of brightener precursors which hydrolyze to dialdehydes in alloy plating baths of the invention.

EXAMPLE 1

Electroplating baths containing tin and lead methane sulfonate and methane sulfonic acid were prepared to determine the effect of the various defoamers. Aeration of the solution in a glass cylinder generated data on the initial foam height and on foam collapse, displayed in Table I. All initial foam heights are lower and collapse times much shorter than those of the control, which contains no defoamer.

TABLE 1[1]

| Defoamer Type | (g/l) | Sn (g/l) | Pb (g/l) | MSA (g/l) | Surfactant[2] (g/l) | Foam Height (initial) | Foam Height After 5 min. |
|---|---|---|---|---|---|---|---|
| None | 0 | 39 | 2.8 | 140 | 5.6 | 34.0 cm | 14 cm |
| Pluronic L-61 | 6 | 39 | 2.8 | 140 | 5.6 | 33.5 cm | 0 cm |
| Octylphenoxy-ethanol | 1 | 39 | 2.8 | 140 | 5.6 | 28.0 cm | 0 cm |
| 2-Ethyl-hexanol | 2.1 | 39 | 2.8 | 140 | 5.6 | 22.0 cm | 0 cm |

[1]Air was pumped through a sintered glass disc into a 41 mm id glass cylinder at the rate of 900 ml/min. after adding 40 ml of the plating solution to the tube.
[2]Dibenzyl(phenoxypolyethyleneoxy)ethanol In Examples 2–9, brass panels were plated in a 267 ml. Hull cell to test the electroplating baths of the invention. Plating was carried out for 2 minutes at 5 amps and 20°–25° with cathode rod agitation. Specific bath formulations and results are shown below.

EXAMPLES 2 and 3

| Bath Composition | Example 2 | Example 3 |
|---|---|---|
| Tin methane sulfonate (as Sn) | 34 g/l | 34 g/l |
| 70% Methane sulfonic acid | 203 g/l | 203 g/l |
| Distyrylphenoxy(polyethoxy)ethanol | 7.5 g/l | 7.5 g/l |
| 1-Tridecanol | 0.62 g/l | 0.62 g/l |
| Malonaldehyde bis(dimethylacetal) | 1.2 g/l | 1.2 g/l |
| Antioxidant | 0.3 g/l | 0.3 g/l |
| 2',4'-Dichloroacetophenone | 0 g/l | 0.2 g/l |

Appearance of the Deposits

Example 2: The panel is black above 200 amps per square foot (ASF). There is a narrow bright strip at 75 ASF. The remainder of the panel is grey.

Example 3: The panel is bright from the high current density edge down to 75 ASF. Below 75 ASF, the deposit is hazy.

EXAMPLES 4 and 5

| Bath Composition | Example 4 | Example 5 |
|---|---|---|
| Tin methane sulfonate (as Sn) | 39 g/l | 39 g/l |
| Lead methane sulfonate (as Pb) | 2.8 g/l | 2.8 g/l |
| 70% methane sulfonic acid | 203 g/l | 203 g/l |
| Alkylphenoxy(polyethoxy)ethanol | 3.75 g/l | 3.75 g/l |
| 2-Ethylhexanol | 0.16 g/l | 0.16 g/l |
| 1-Napthaldehyde | 0.02 g/l | 0.02 g/l |
| 2-Hydroxyhexanediol | 0 g/l | 0.5 g/l |

Appearance of the Deposits

Example 4: From the high current density edge down to 150 ASF, the deposit is dark. Below 150 ASF, the deposit is bright and semi-white (the alloy is 90 percent tin).

Example 5: The panel is bright and totally reflective from the high current edge to 150 ASF (the alloy is 90 percent tin).

EXAMPLES 6 and 7

| Bath Composition | Example 6 | Example 7 |
|---|---|---|
| Tin methane sulfonate (as Sn) | 34 g/l | 34 g/l |
| Lead methane sulfonate (as Pb) | 19 g/l | 19 g/l |
| 70% Methane sulfonic acid | 253 g/l | 253 g/l |
| Pluronic L-31 | 5.7 g/l | 5.7 g/l |
| Nonylphenoxyethanol | 0.18 g/l | 0.18 g/l |
| Antioxidant | 0.3 g/l | 0.3 g/l |
| 2,4-Dichlorobenzaldehyde | 0.01 g/l | 0.01 g/l |
| 2,5-Dimethoxytetrahydrofuran | 0 g/l | 1.1 g/l |

Appearance of the Deposits

Example 6: The deposit is a grey matte at all current densities (the alloy is 60 percent tin).

Example 7: The deposit is bright from 50 to 150 ASF (the alloy is 60 percent tin).

EXAMPLES 8 and 9

| Bath Composition | Example 8 | Example 9 |
|---|---|---|
| Tin methane sulfonate (as Sn) | 39 g/l | 39 g/l |
| Lead methane sulfonate (as Pb) | 2.8 g/l | 2.8 g/l |
| 70% Methane sulfonic acid | 203 g/l | 203 g/l |
| Distyrylphenoxy(polyethoxy)ethanol | 6.2 g/l | 6.2 g/l |
| Ethoxylated amine | 1.9 g/l | 1.9 g/l |
| 3,7-Dimethyloctanol | 0.3 g/l | 0.3 g/l |
| Antioxidant | 0.3 g/l | 0.3 g/l |
| 1-Napthaldehyde | 0.03 g/l | 0.03 g/l |
| 2-Ethoxy-3,4-dihydropyran | 0 ml/l | 1.1 ml/l |

Appearance of the Deposits

Example 8: The 90 percent tin deposit is dark from the high current density edge to 150 ASF, bright from 75–150 ASF, and white below 75 ASF.

Example 9: The 90 percent tin deposit is bright from 75 to about 250 ASF.

EXAMPLES 10 AND 11

| Bath Composition | Example 10 | Example 11 |
|---|---|---|
| Tin methane sulfonate (as Sn) | 56 g/l | 56 g/l |
| 70% Methane sulfonic acid | 203 g/l | 203 g/l |
| Distyrylphenoxy(polyethoxy)ethanol | 5.6 g/l | 5.6 g/l |
| 3,7-Dimethyloctanol | 0.3 g/l | 0.3 g/l |
| Glutaric dialdehyde | 1.4 g/l | 1.4 g/l |
| Antioxidant | 0.3 g/l | 0.3 g/l |
| Trans-cinnamaldehyde | 0 | 0.04 g/l |

Appearance of the Deposits

Example 10: The panel is bright from 200 ASF to the edge of the panel. There is a narrow hazy bright strip at 125 ASF. The rest of the panel is grey.

Example 11: The panel is mirror bright from 50 to above 250 ASF.

ADDITIONS SUBSTITUTIONS

Other ingredients can be added to the plating baths of the present invention to achieve further objectives. For instance, a reducing agent can be added to retard the formation of sludges due to some of the tin precipitating from solution as a result of being oxidized either at the anode or in solution to the plus four oxidation state. The plating baths of the invention are compatible with most commonly used antioxidants, for instance, resorcinol, catechol, and hydroquinone sulfonate. In the preferred embodiment of the invention, the antioxidant is 1-phenyl-3-pyrazolidinone, used preferably in the concentration range of from about 0.1–0.8 grams per liter, most preferably at from about 0.15–0.40 grams per liter.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A tin or tin-lead alloy plating bath for the electrodeposition of bright plates which comprises:

A. a plating bath containing a bath soluble alkane or alkanol sulfonic acid;

B. tin alkane or alkanol sulfonate or both tin and lead alkane or alkanol sulfonate;

C. a first low volatility brightening agent selected from the group consisting of dialdehyde precursors capable of undergoing acid hydrolysis under plating bath conditions, selected from the group consisting of a substituted dihydropyran represented by the following two formulas:

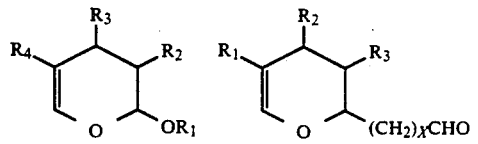

wherein $R_1$, $R_2$, $R_3$, and $R_4$ represent hydrogen or a $C_{1-5}$ alkyl group; x is an integer from 0 to 5; and D. a second low volatility brightening agent selected from the group consisting of (a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

2. A tin or tin-lead alloy plating bath for the electrodeposition of bright plates which comprises:

A. a plating bath containing a bath soluble alkane or alkanol sulfonic acid;
B. tin alkane or alkanol sulfonate or both tin and lead alkane or alkanol sulfonate;
C. a first low volatility brightening agent selected from the group consisting of dialdehyde precursors capable of undergoing acid hydrolysis under plating bath conditions, selected from the group consisting of
substituted dihydrofurans represented by the formulas

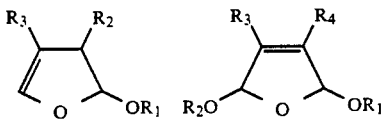

wherein $R_1$, $R_2$, $R_3$ and $R_4$ represent hydrogen or a $C_{1-5}$ alkyl group; and D. a second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

3. A tin or tin-lead alloy plating bath for the electrodeposition of bright plates which comprises:

A. a plating bath containing a bath soluble alkane or alkanol sulfonic acid;
B. tin alkane or alkanol sulfonate or both tin and lead alkane or alkanol sulfonate;
C. at least one low volatility brightening agent selected from the group consisting of
a dialdehyde precursor capable of undergoing acid hydrolysis selected from the group consisting of substituted tetrahydrofuran represented by the formula

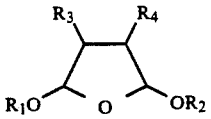

wherein $R_1$, $R_2$, $R_3$ and $R_4$ represent hydrogen or a $C_{1-5}$ alkyl group; and D. at least one second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

4. A tin or tin-lead alloy plating bath for the electrodeposition of bright plates which comprises:

A. a plating bath containing a bath soluble alkane or alkanol sulfonic acid;
B. tin alkane or alkanol sulfonate or both tin and lead alkane or alkanol sulfonate;
C. at least one low volatility brightening agent selected from the group consisting of a dialdehyde precursor capable of undergoing acid hydrolysis selected from the group consisting of
acetals of dialdehyde represented by the formula

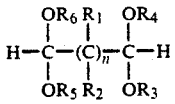

wherein $R_1$, $R_2$, $R_3$, $R_4$, $R_5$ and $R_6$ represent hydrogen or a $C_{1-5}$ alkyl group; n is an integer from 1 to 10; and D. at least one second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

5. A tin or tin-lead alloy plating bath for the electrodeposition of bright plates which comprises:

A. a plating bath containing a bath soluble alkane or alkanol sulfonic acid;
B. tin alkane or alkanol sulfonate or both tin and lead alkane or alkanol sulfonate;
C. at least one low volatility brightening agent selected from the group consisting of a dialdehyde precursor capable of undergoing acid hydrolysis selected from the group consisting of
hydroxysulfonates represented by the formula

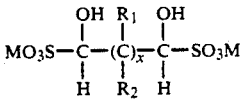

wherein $R_1$ and $R_2$ represent hydrogen, hydroxy-, or a $C_{1-5}$ alkyl group; M is an alkali metal, x is an integer from 0 to 10; and D. at least one second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

6. A tin or tin-lead alloy plating bath for the electrodeposition of bright plate which consists essentially of:

A. a plating bath containing a bath soluble alkane or alkanol sulfonic acid;
B. tin alkane or alkanol sulfonate or both tin and lead alkane or alkanol sulfonate;
C. a first low volatility brightening agent selected from the group consisting of
(a) a dialdehyde precursor capable of undergoing acid hydrolysis selected from the group consisting of
i. a substituted dihydropyran represented by the following two formulas:

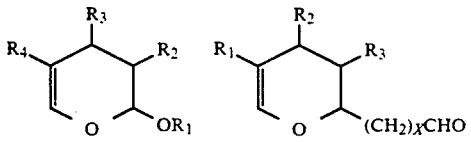

wherein $R_1$, $R_2$, $R_3$, and $R_4$ represent hydrogen or a $C_{1-5}$ alkyl group; x is an integer from 0 to 5; and/or ii. a substituted dihydrofuran represented by the formulas

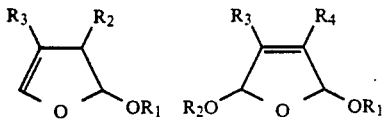

wherein $R_1$, $R_2$, $R_3$ and $R_4$ represent hydrogen or a $C_{1-5}$ alkyl group; and/or iii. a substituted tetrahydrofuran represented by the formula

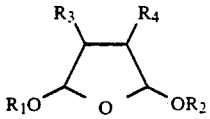

wherein $R_1$, $R_2$, $R_3$ and $R_4$ represent hydrogen or a $C_{1-5}$ alkyl group; and/or iv. an acetal of dialdehyde represented by the formula

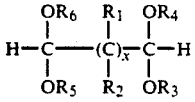

wherein $R_1$, $R_2$, $R_3$, $R_4$, $R_5$ and $R_6$ represent hydrogen or a $C_{1-5}$ alkyl group; x is an integer from 1 to 10; and/or v. a hydroxysulfonate represented by the formula

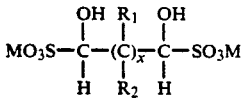

wherein $R_1$ and $R_2$ represent hydrogen, hydroxy-, or a $C_{1-5}$ alkyl group; M is an alkali metal, x is an integer from 0 to 10;

D. a second low volatility brightening agent selected from the group consisting of (a) aromatic aldehydes and substituted aromatic aldehydes, excluding benzaldehyde; and/or (b) aromatic ketones or substituted aromatic ketones; and/or (c) carboxaldehydes of heterocyclic rings or substituted heterocyclic rings; and E. a surfactant selected from the group consisting of:

(a) a nonionic surfactant selected from the group represented by the formula

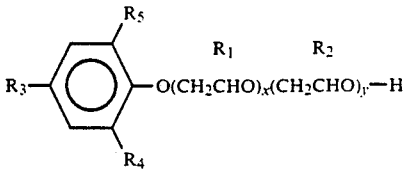

wherein $R_1$ and $R_2$ represent hydrogen or $-CH_3$; $R_3$, $R_4$ and $R_5$ represent H, a $C_{1-20}$ alkyl, benzyl, and/or a styryl group; x and y are integers from 1-30; and/or (b) a nonionic surfactant that is a block copolymer of ethylene and propylene oxide selected from the group represented by the formula

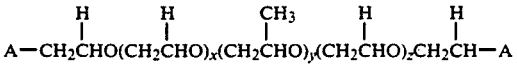

wherein A represents a halogen, —OH, or —OR, where R is a $C_{1-15}$ group; x, y, and z are integers from 1 to 100; and/or (c) a nonionic surfactant that is a block copolymer of ethylene and propylene oxide selected from the group represented by the formula

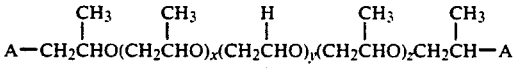

wherein A represents a halogen, —OH, or —OR, where R is a $C_{1-15}$ group; x, y, and z are integers from 1 to 100;

F. a non-silicon defoaming agent selected from the group consisting of:

(a) a polypropylene oxide or nonionic surfactant from the group represented by the formula

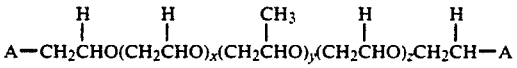

wherein A represents a halogen, —OH, or —OR, where R is a $C_{1-15}$ alkyl group; x, y, z are integers from 1 to 100; with the condition that no more than 10% of the compound is polyethylene oxide; and/or (b) a polyproplyene oxide or nonionic surfactant from the group represented by the formula

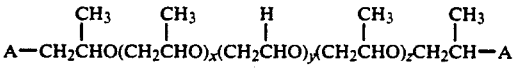

wherein A represents a halogen, —OH, or —OR, where R is a $C_{1-15}$ alkyl group; x, y, z are integers from 1 to 100 with the condition that no more than 10% of the compound is polyethylene oxide; and/or (c) an aliphatic alcohol, represented by the formula

R—OH wherein R is a $C_{5-30}$ alkyl group; and/or (d) an ethoxylated alkyl phenol from the group represented by the formula

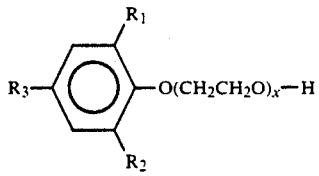

wherein $R_1$, $R_2$ and $R_3$ represent hydrogen or $C_{1-16}$ alkyl groups with the condition that there is at least one alkyl group; x is an integer from 1-5 and G. antioxidants selected from the group consisting of 1-phenyl-3-pyrazolidinone, resorcinol, catechol, and hydroquinone sulfonate.

7. The plating bath according to claim 1, 2, 3, 4, 5, or 6, in which the electrolyte consists of alkane and alkanol sulfonic acids represented by the general formulas $RCH_2SO_3H$ wherein R represents a $C_{1-6}$ alkyl group, and $HO—RSO_3H$ wherein R represents a $C_{1-6}$ alkylene group.

8. The plating bath according to claim 1, 2, 3, 4, 5, or 6, in which the alkane or alkanol sulfonic acid electrolyte is used in concentrations ranging from to 25 percent acid.

9. The plating bath according to claim 1, 2, 3, 4, 5, or 6, in which the tin is supplied as stannous alkane sulfonate or stannous alkanol sulfonate: $Sn(O_3SR)_2$ or $Sn(O_3S—R—OH)_2$, respectively, where total tin metal concentration ranges form 10 to 100 grams per liter.

10. The plating bath according to claim 6, in which the tin is supplied as a tin alkane or alkanol sulfonate or a mixture thereof at a concentration ranging from about 2 to 25 percent, and the lead is supplied as a plumbous alkane sulfonate represented by the formulae:

$Pb(O_3SR)_2$ or $Pb(O_3S\text{-}R\text{-}OH)_2$ wherein R represents a $C_{1-12}$ alkyl group and where the total tin metal concentration ranges and the total lead metal concentration ranges from about 0.25 to about 50 grams per liter.

11. The plating bath according to claim 6, in which the defoamer is used in concentrations of 0.01 to about 30 grams per liter.

12. The plating bath according to claim 1, 2, 3, 4, 5, or 6, in which the dialdehyde brightener or its precursor is used in concentrations of 0.1 to 20 grams per liter.

13. The plating bath according to claim 1, 2, 3, 4, 5, or 6, in which the aromatic aldehyde and/or the aromatic ketone and/or the carboxaldehyde substituted heterocyclic ring is used in concentrations of from about 0.005 to about 0.5 grams per liter.

14. The plating bath according to claim 6, in which the antioxidant is used in concentrations of from about 0.1 to about 0.8 grams per liter.

15. A process for producing a bright electroplate of tin or tin-lead comprising contacting an electroplatable object, with an electroplating bath as defined in claim 1, 2, 3, 4, 5, or 6.

16. The process of claim 15, wherein bath electrolytes are selected from bath soluble alkane or alkanol sulfonic acids.

17. The process of claim 15, wherein the source of tin or tin and lead is alkane or alkanol sulfonate containing each of the metals in the plus two oxidation state.

18. The process of claim 15, wherein the plating bath contains at least one of the low to moderate foaming surfactants of claim 7 in a concentration between about 1 and about 15 grams per liter.

19. The process of claim 15, wherein the plating bath contains at least one of the nonsilicon containing defoamers of claim 7.

20. The process of claim 15, wherein the plating bath contains an aliphatic dialdehyde, substituted aliphatic dialdehyde, or a precursor hydrolyzable to an aliphatic dialdehyde or a substituted aliphatic dialdehyde in an acidic plating bath.

21. The process of claim 15, wherein the plating bath contains a low volatility brightening agent selected from the group consisting of:

(a) aromatic aldehydes and substituted aromatic aldehydes and/or their acid hydrolyzable precursors; and/or (b) aromatic ketones or substituted aromatic ketones; and/or (c) carboxaldehydes of heterocyclic rings or substituted heterocyclic rings.

22. The process of claim 15, wherein the plating bath contains an antioxidant selected from resorcinol, catechol, hydroquinone sulfonate, or 1-phenyl-3-pyrazolidinone.

23. The process of claim 15, wherein said process results in a semi-bright finish.

24. The process of claim 15, wherein said process results in a mirror-bright finish.

25. A tin or tin-lead alloy plating bath for the electrodeposition of bright plates which comprises:

A. a plating bath containing a bath soluble alkane or alkanol sulfonic acid;

B. tin alkane or alkanol sulfonate or both tin and lead alkane or alkanol sulfonate;

C. a brightening agent selected from the group consisting of a non-volatile brightness selected from the group of i. a substituted dihydropyran represented by the following two formulae:

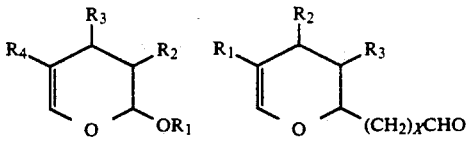

wherein $R_1$, $R_2$, $R_3$, and $R_4$ represent hydrogen or a $C_{1-5}$ alkyl group; x is an integer from 0 to 5; and/or ii. a substituted dihydrofuran represented by the formulae:

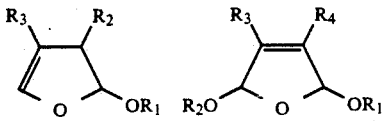

wherein $R_1R_2$, $R_3$ and $R_4$ represent hydrogen or a $C_{1-5}$ alkyl group; and/or iii. a substituted tetrahydrofuran represented by the formula

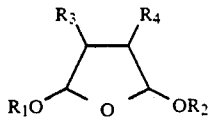

wherein $R_1$, $R_2$, $R_3$ and $R_4$ represent hydrogen or a $C_{1-5}$ alkyl group; and/or iv. an acetal of dialdehyde represented by the formula

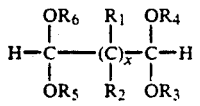

wherein $R_1$, $R_2$, $R_3$, $R_4$, $R_5$ and $R_6$ represent hydrogen or a $C_{1-5}$ alkyl group; x is an integer from 1 to 10; and/or v. a hydroxysulfonate represented by the formula

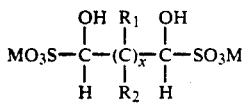

wherein $R_1$ and $R_2$ represent hydrogen, hydroxyl, or a $C_{1-5}$ alkyl group; M is an alkali metal, x is an integer from 0 to 10;

D. second low volatility brightening agent selected from the group consisting of (a) aromatic aldehydes and substituted aromatic aldehydes, excluding benzaldehyde; and/or (b) aromatic ketones or substituted aromatic ketones; and/or (c) carboxaldehydes of heterocyclic rings or substituted heterocyclic rings; and E. a surfactant selected from the group consisting of:

(a) a nonionic surfactant selected from the group represented by the formula

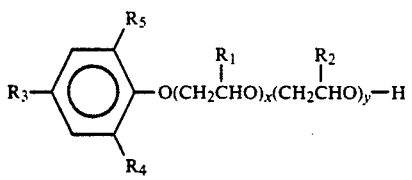

wherein $R_1$ and $R_2$ represent hydrogen or $-CH_3$; $R_3$, $R_4$ and $R_5$ represent H, a $C_{1-20}$ alkyl, benzyl, and/or a styryl group; x and y are integers from 1-30; and/or (b) a nonionic surfactant that is a block copolymer of ethylene and propylene oxide selected from the group represented by the formula

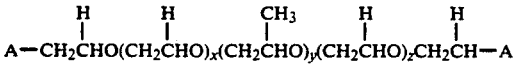

wherein A represents a halogen, —OH, or —OR, where R is a $c_{1-15}$ group; x, y, an dz are integers from 1 to 100; and/or (c) a nonionic surfactant that is a block copolymer of ethylene and propylene oxide selected from the group represented by the formula

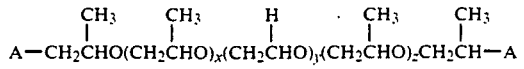

wherein A represents a halogen, —OH, or —OR, where R is a $C_{1-15}$ group: x, y, and z are integers from 1 to 100;

F. a non-silicon defoaming agent selected from the group consisting of:

(a) a polypropylene oxide or nonionic surfactant from the group represented by the formula

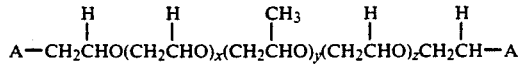

wherein A represents a halogen, —OH, or —OR, where R is a $C_{1-15}$ alkyl group; x, y, z are integers from 1 to 100; with the condition that no more than 10% of the compound is polyethylene oxide; and/or (b) a polypropylene oxide or nonionic surfactant from the group represented by the formula

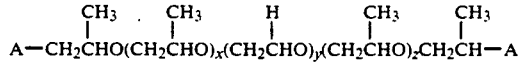

wherein A represents a halogen, —OH, or —OR, where R is a $C_{1-15}$ alkyl group; x, y, z are integers from 1 to 100 with the condition that no more than 10% of the compound is polyethylene oxide; and/or (c) analiphatic alcohol, represented by the formula,

R—OH wherein R is a $C_{5-30}$ alkyl group; and/or (d) an ethoxylated alkyl phenol from the group represented by the formula

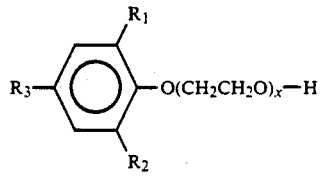

wherein $R_1$, $R_2$ and $R_3$ represent hydrogen or $C_{1-16}$ alkyl groups with the condition that there is at least one alkyl group; x is an integer from 1-5; and G. antioxidants selected from the group consisting of 1-phenyl-3-pyrazolidinone, resorcinol, catechol, and hydroquinone sulfonate.

26. A tin or tin-led alloy plating bath according to claim 25 for the electrodeposition of bright plates which consists essentially of:

A. a plating bath containing a bath soluble alkane or alkanol sulfonic acid;

B. tin alkane or alkanol sulfonate or both tin and lead alkane or alkanol sulfonate;

C. a first low volatility brightening agent selected from the group consisting of dialdehyde precursors capable of undergoing acid hydrolysis under plating bath conditions, selected from the group consisting of a substituted dihydropyran represented by the following two formulae:

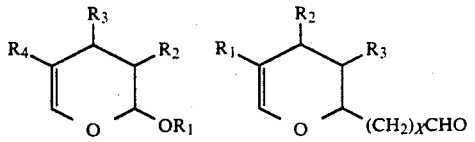

wherein $R_1$, $R_2$, $R_3$, and $R_4$ represent hydrogen or a $C_{1-5}$ alkyl group; x is an integer from 0 to 5; and D. a second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

27. A tin or tin-lead alloy plating bath according to claim 25 for the electrodeposition of bright plates which consists essentially of:

A. a plating bath containing a bath soluble alkane or alkanol sulfonic acid;
B. tin alkane or alkanol sulfonate or both tin and lead alkane or alkanol sulfonate;
C. a first low volatility brightening agent selected from the group consisting of dialdehyde precursors capable of undergoing acid hydrolysis under plating bath conditions, selected from the group consisting of
substituted dihydrofurans represented by the formulae:

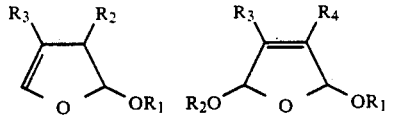

wherein $R_1$, $R_2$, $R_3$ and $R_4$ represent hydrogen or a $C_{1-5}$ alkyl group; and D. a second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

28. A tin or tin-lead alloy plating bath according to claim 25 for the electrodeposition of bright plates which consists essentially of:

A. a plating bath containing a bath soluble alkane or alkanol sulfonic acid;
B. tin alkane or alkanol sulfonate or both tin and lead alkane or alkanol sulfonate;
C. at least one low volatility brightening agent selected from the group consisting of
a dialdehyde precursor capable of undergoing acid hydrolysis selected from the group consisting of substituted tetrahydrofurans represented by the formula

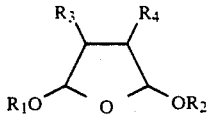

wherein $R_1$, $R_2$, $R_3$ and $R_4$ represent hydrogen or a $C_{1-5}$ alkyl group; and D. at least one second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

29. A tin or tin-lead alloy plating bath of claim 25 for the electrodeposition of bright plates which consists essentially of:

A. a plating bath containing a bath soluble alkane or alkanol sulfonic acid;
B. tin alkane or alkanol sulfonate or both tin and lead alkane or alkanol sulfonate;
C. at least one low volatility brightening agent selected from the group consisting of a dialdehyde precursor capable of undergoing acid hydrolysis selected from the group consisting of
acetals of dialdehyde represented by the formula

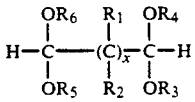

wherein $R_1$, $R_2$, $R_3$, $R_4$, $R_5$ and $R_6$ represent hydrogen or a $C_{1-5}$ alkyl group; x is an integer from 1 to 10; and D. at least one second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

30. A tin or tin-lead alloy plating bath of claim 25 for the electrodeposition of bright plates which consists essentially of:

A. a plating bath containing a bath soluble alkane or alkanol sulfonic acid;
B. tin alkane or alkanol sulfonate or both tin and lead alkane or alkanol sulfonate;
C. at least one low volatility brightening agent selected from the group consisting of a dialdehyde precursor capable of undergoing acid hydrolysis selected from the group consisting of
hydroxysulfonates represented by the formula

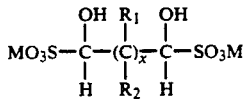

wherein $R_1$ and $R_2$ represent hydrogen, hydroxyl, or a $C_{1-5}$ alkyl group; M is an alkali metal, x is an integer from 0 to 10; and D. at least one second low volatility brightening agent selected from the group consisting of
(a) aromatic aldehydes and substituted aromatic aldehydes, with the exception of benzaldehyde;
(b) aromatic ketones or substituted aromatic ketones; and
(c) carboxaldehydes of heterocyclic rings or substituted heterocyclic rings.

31. The plating bath according to claim 25, in which the electrolyte consists of alkane and alkanol sulfonic acids represented by the following two general formulae:

$$RCH_2SO_3H$$

wherein R represents H or a $C_{1-6}$ alkyl group, and $$HO—RSO_3H$$

wherein R represents a $C_{1-6}$ alkylene group.

32. The plating bath according to claim 25, in which the alkane or alkanol sulfonic acid electrolyte is used in concentrations ranging from 2 to 25 percent acid.

33. The plating bath according to claim 25, in which the tin is supplied as stannous alkane sulfonate or stannous alkanol sulfonate: $Sn(O_3SR)_2$ or $SN(O_3S—R—OH)_2$, respectively, where total tin metal concentration ranges from about 10 to 100 grams per liter.

34. The plating bath according to claim 25, in which the lead is supplied as plumbous alkane sulfonate or plumbous alkanol sulfonate: $Pb(O_3SR)_2$ or $Pb(O_3S—R—OH)_2$, respectively, where total tin metal concentration range is from about 10 to 100 grams per liter and the total lead metal concentration range is from about 0.25 to about 50 grams per liter.

35. The plating bath according to claim 25, in which the defoamer is used in concentrations ranging from about 0.01 to about 30 grams per liter.

36. The plating bath according to claim 25, in which the non-volatile brightening is used in concentrations ranging from about 0.1 to 20 grams per liter.

37. The plating bath according to claim 25, in which the aromatic aldehyde and/or the aromatic ketone and/or the carboxaldehyde substituted hetrocyclic ring are each used in concentrations ranging from about 0.005 to about 0.5 grams per liter.

38. The plating bath according to claim 25, in which the antioxidant is used in concentrations of from about 0.1 to about 0.8 grams per liter.

39. A method for producing a bright electroplate coating of tin or tin-lead on an electroplatable object comprising contacting an electroplatable object with a tin or tin-lead alloy plating bath which comprises:

A. a plating bath containing a bath soluble alkane or alkanol sulfonic acid;
B. tin alkane or alkanol sulfonate or both tin and lead alkane or alkanol sulfonate;
C. a brightening agent selected from the group consisting of a non-volatile brighteners selected from the group of
i. a substituted dihydropyran represented by the following two formulae:

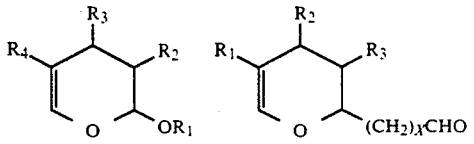

wherein $R_1$, $R_2$, $R_3$, and $R_4$ represent hydrogen or a $C_{1-5}$ alkyl group; x is an integer from 0 to 5; and/or ii. a substituted dihydrofuran represented by the formulae:

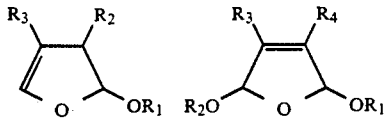

wherein $R_1$, $R_2$, $R_3$ and $R_4$ represent hydrogen or a $C_{1-5}$ alkyl group; and/or iii. a substituted tetrahydrofuran represented by the formula

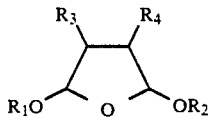

wherein $R_1$, $R_2$, $R_3$ and $R_4$ represent hydrogen or a $C_{1-5}$ alkyl group; and/or iv. an acetal of dialdehyde represented by the formula

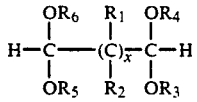

wherein $R_1$, $R_2$, $R_3$, $R_4$, $R_5$ and $R_6$ represent hydrogen or a $C_{1-5}$ alkyl group; x is an integer form 1 to 10; and/or v. a hydroxysulfonate represented by the formula

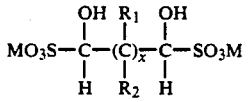

wherein $R_1$ and $R_2$ represent hydrogen, hydroxyl, or a $C_{1-5}$ alkyl group; M is an alkali metal, x is an integer from 0 to 10;

D. a second low volatility brightening agent selected from the group consisting of
(a) aromatic aldehydes and substituted aromatic aldehydes, excluding benzaldehyde; and/or
(b) aromatic ketones or substituted aromatic ketones; and/or
(c) carboxaldehydes of heterocyclic rings or substituted heterocyclic rings; and E. a surfactant selected from the group consisting of:
(a) a nonionic surfactant selected from the group represented by the formula

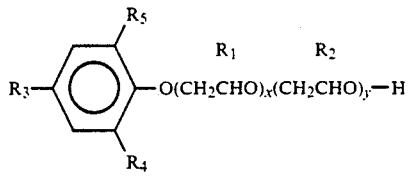

wherein $R_1$ and $R_2$ represent hydrogen or $-CH_3$; $R_3$, $R_4$ and $R_5$ represent H, a $C_{1-20}$ alkyl, benzyl, and/or a styryl group; x and y are integers from 1-30; and/or (b) a nonionic surfactant that is a block copolymer of ethylene and propylene oxide selected from the group represented by the formula $$A-\overset{H}{\overset{|}{C}}H_2CHO(CH_2CHO)_x(\overset{CH_3}{\overset{|}{C}}H_2CHO)_y(\overset{H}{\overset{|}{C}}H_2CHO)_z\overset{H}{\overset{|}{C}}H_2CH-A$$

wherein A represents a halogen, —OH, or —OR, where R is a $C_{1-15}$ group; x, y, and z are integers from 1 to 100; and/or (c) a nonionic surfactant that is a block copolymer of ehtylene and propylene oxide selected from the group represented by the formula $$A-\overset{CH_3}{\overset{|}{C}}H_2CHO(\overset{CH_3}{\overset{|}{C}}H_2CHO)_x(\overset{H}{\overset{|}{C}}H_2CHO)_y(\overset{CH_3}{\overset{|}{C}}H_2CHO)_z\overset{CH_3}{\overset{|}{C}}H_2CH-A$$

wherein A represents a halogen, —OH, or —OR, where R is a $C_{1-15}$ group; x, y, and z are integers from 1 to 100;

F. a non-silicon defoaming agent selected from the group consisting of:

(a) a polypropylene oxide or nonionic surfactant from the group represented by the formula $$A-\overset{H}{\overset{|}{C}}H_2CHO(\overset{H}{\overset{|}{C}}H_2CHO)_x(\overset{CH_3}{\overset{|}{C}}H_2CHO)_y(\overset{H}{\overset{|}{C}}H_2CHO)_z\overset{H}{\overset{|}{C}}H_2CH-A$$

wherein A represents a halogen, —OH, or —OR, where R is a $C_{1-15}$ alkyl group; x, y, z are integers from 1 to 100; with the condition that no more than 10% of the compound is polyethylene oxide; and/or (b) a polypropylene oxide or nonionic surfactant from the group represented by the formula $$A-\overset{CH_3}{\overset{|}{C}}H_2CHO(\overset{CH_3}{\overset{|}{C}}H_2CHO)_x(\overset{H}{\overset{|}{C}}H_2CHO)_y(\overset{CH_3}{\overset{|}{C}}H_2CHO)_z\overset{CH_3}{\overset{|}{C}}H_2CH-A$$

wherein A represents a halogen, —OH, or —OR, where R is a $C_{1-15}$ alkyl group; x, y, z are integers from 1 to 100 with the condition that no more than 10% of the compound is polyethylene oxide; and/or (c) an aliphatic alcohol, represented by the formula

R-OH wherein R is a $C_{5-30}$ alkyl group; and/or (d) an ethoxylated alkyl phenol from the group represented by the formula

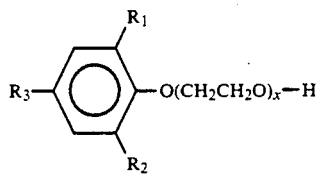

wherein $R_1$, $R_2$ and $R_3$ represent hydrogen or $C_{1-16}$ alkyl groups with the condition that there is at least one alkyl group; x is an integer from 1-5; and G. antioxidant selected from the group consisting of 1-phenyl-3-pyrazolidinone, resorcinol, catechol, and hydroguinone sulfonate.

40. The method of claim 39, wherein bath electrolytes are selected from bath soluble alkane or alkanol sulfonic acids.

41. The method of claim 39, wherein the source of tin or tin and lead is alkane or alkanol sulfonate containing each of the metals in the plus two oxidation state.

42. The method of claim 39, wherein the plating bath contains at least one low to moderate foaming surfactant in a concentration range between about 1 and about 15 grams per liter.

43. The method of claim 39, wherein the plating bath contains at least one nonsilicon containing defoamer.

44. The method of claim 39, wherein the plating bath further contains a nonvolatile brightener consisting of a substituted dihydropyran, a substituted dihydrofuran, a substituted tetrahydrofuran, an acetal of a dialdehyde, or a hydrosulfonate of a dialdehyde.

45. The method of claim 39, wherein the plating bath further contains a low volatility brightening agent selected from the group consisting of:

(a) aromatic aldehydes and substituted aromatic aldehydes and/or their acid hydrolyzable precursors;

(b) aromatic ketones or substituted aromatic ketones;

(c) carboxaldehydes of heterocyclic rings or substituted heterocyclic rings;

(d) and mixtures thereof.

46. The method of claim 39, wherein the plating bath further contains an antioxidant selected from the group consisting of resorcinol, catechol, hydroquinone sulfonate, and 1-phenyl-3-pyrazolidinone.

47. The method of claim 39, wherein said method yields a semi-bright electroplated finish on the object electroplated thereby.

48. The method of claim 39, wherein said method yields a mirror-bright finish on the object electroplated thereby.

* * * * *